US006751820B1

(12) United States Patent
Wu

(10) Patent No.: US 6,751,820 B1
(45) Date of Patent: Jun. 22, 2004

(54) DETACHABLE COMBINATION TOOL

(76) Inventor: Shuh Wu, No. 1, Alley 16, Lane 40, Jinn Te Rd., Taichung (TW)

( * ) Notice: Subject to any disclaimer, the term of this patent is extended or adjusted under 35 U.S.C. 154(b) by 0 days.

(21) Appl. No.: 10/464,608

(22) Filed: Jun. 16, 2003

(51) Int. Cl.[7] ..... B26B 11/00

(52) U.S. Cl. ..... 7/118; 7/158; 7/167; 7/168; 7/138; 81/427.5; 30/153

(58) Field of Search ..... 7/118, 158, 167, 7/168, 138, 142; 81/427.5, 177.4, 440; 30/153, 155, 160, 161

(56) References Cited

U.S. PATENT DOCUMENTS 5,711,042 A * 1/1998 Chuang ..... 7/138
6,286,168 B1 * 9/2001 Woodruff et al. ..... 7/138
6,564,678 B1 * 5/2003 Wang ..... 81/124.4
6,574,817 B2 * 6/2003 Wu ..... 7/138
6,622,329 B2 * 9/2003 Ostor et al. ..... 7/138

* cited by examiner

*Primary Examiner*—Joseph J. Hail, III
*Assistant Examiner*—Alvin J Grant

(57) ABSTRACT

A detachable combination tool includes a first body, a second body, two locking blocks, and an elastic member. Thus, the second body can be detached from the first body easily and conveniently, so that the second body and the first body can be used independently, thereby facilitating the user operating the combination tool. In addition, the detachable combination tool can withstand a larger torque or force during operation.

12 Claims, 14 Drawing Sheets

DETACHABLE COMBINATION TOOL

BACKGROUND OF THE INVENTION

1. Field of the Invention

The present invention relates to a detachable combination tool that can withstand a larger torque or force during operation.

2. Description of the Related Art

A conventional combination tool comprises a first tool and a second combined with each other. The first tool has a female snap formed with a concave portion, and the second tool has a male snap formed with a convex portion inserted into the concave portion of the female snap of the first tool, thereby combining the first tool with the second tool. However, the first tool is easily detached from the second tool, thereby causing inconvenience to the user during operation.

SUMMARY OF THE INVENTION

The primary objective of the present invention is to provide a detachable combination tool that can withstand a larger torque or force during operation.

Another objective of the present invention is to provide a detachable combination tool, wherein the second body can be mounted on and detached from the first body easily and conveniently by pressing the two locking blocks, thereby facilitating the user assembling and disassembling the combination tool.

A further objective of the present invention is to provide a detachable combination tool, wherein the second body can be detached from the first body easily and conveniently, so that the second body and the first body can be used individually and independently, thereby facilitating the user operating the combination tool.

In accordance with the present invention, there is provided a detachable combination tool, comprising a first body, a second body, and two locking blocks, wherein:

- the first body has an inside formed with a receiving chamber;
- the receiving chamber of the first body has two sides each formed with a snap recess;
- the second body is detachably mounted on the first body and has a bottom provided with a protruding block received in the receiving chamber of the first body;
- the protruding block of the second body has two sides each formed with a through hole aligning with the respective snap recess of the first body; and
- each of the two locking blocks is movably mounted on the second body and has a bottom provided with a protruding locking portion extended through the respective through hole of the protruding block of the second body and detachably locked in the respective snap recess of the first body, so that the second body is detachably fixed to the first body by the two locking blocks.

Further benefits and advantages of the present invention will become apparent after a careful reading of the detailed description with appropriate reference to the accompanying drawings.

DETAILED DESCRIPTION OF THE INVENTION

Figure 1:
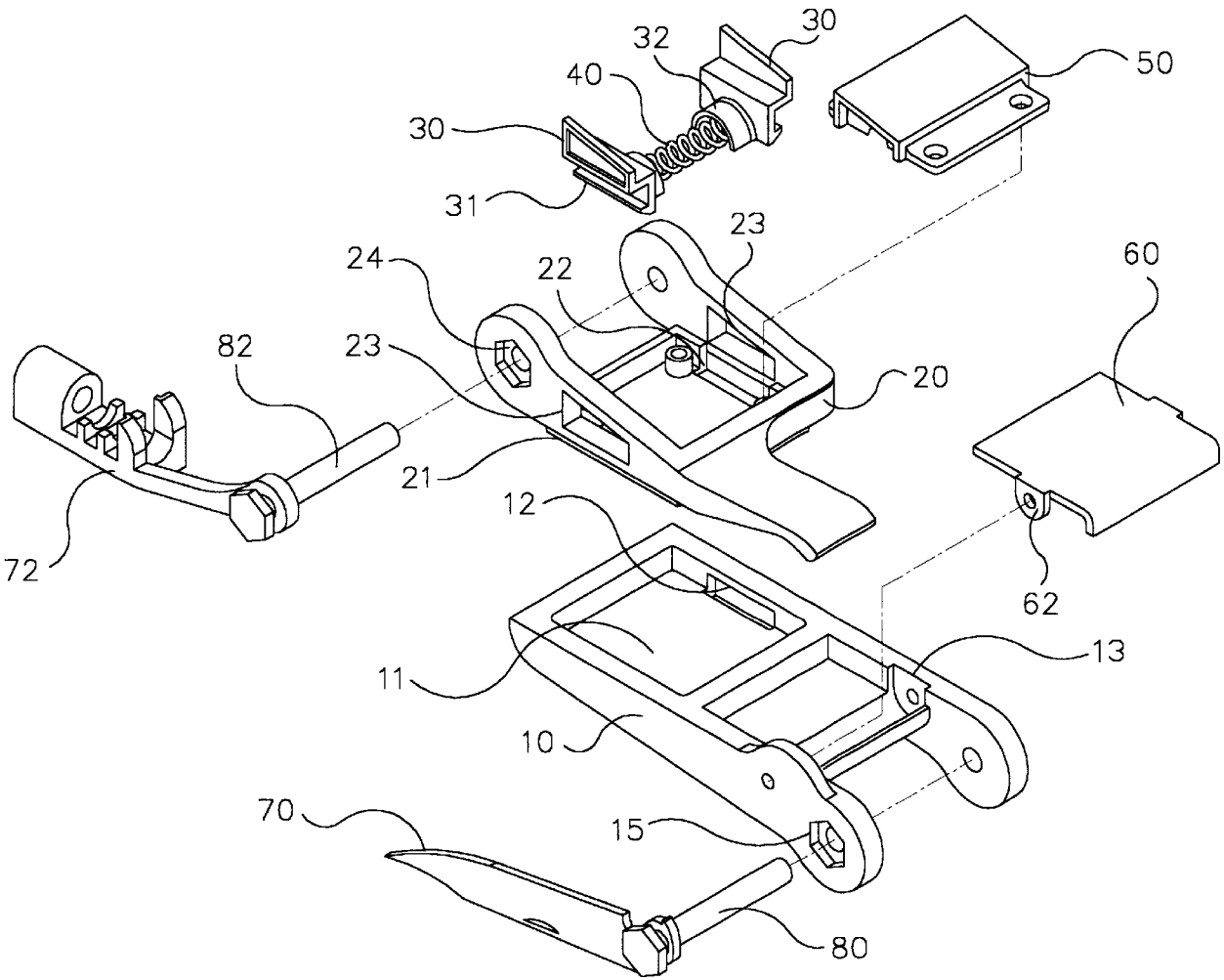
FIG. 1 is an exploded perspective view of a detachable combination tool in accordance with the preferred embodiment of the present invention.
Figure 2:
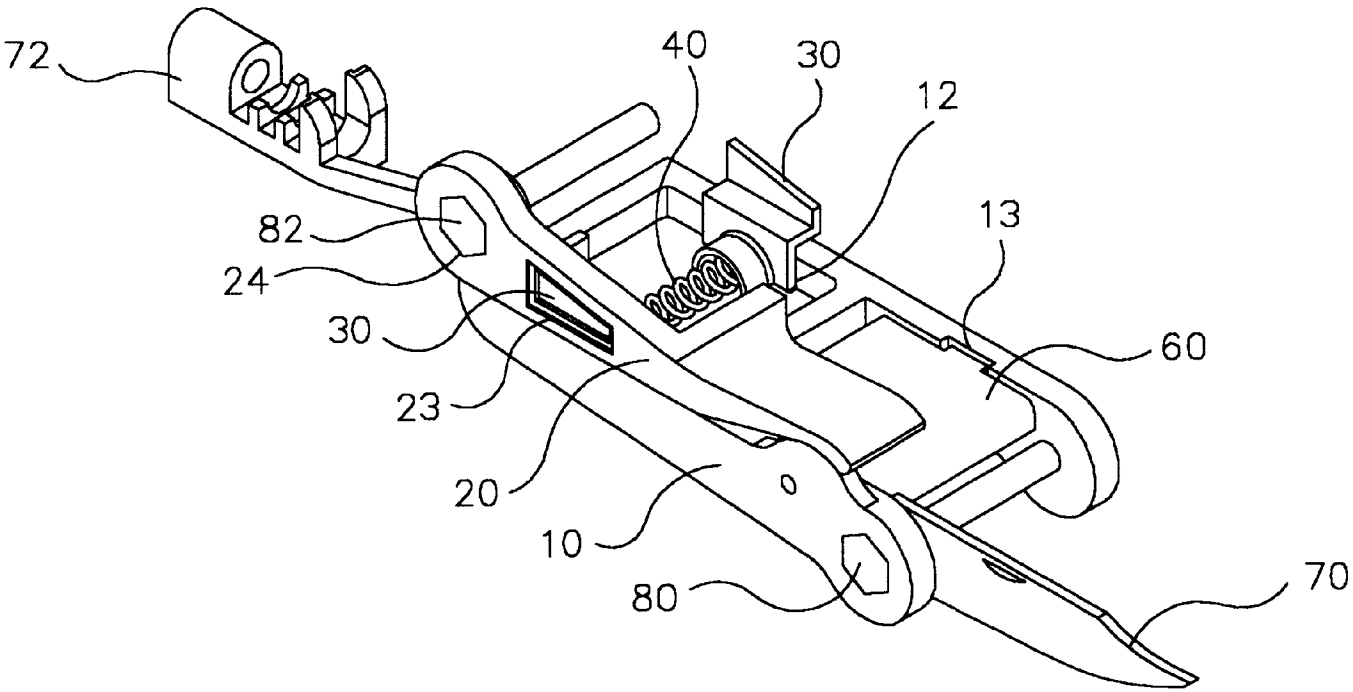
FIG. 2 is a perspective assembly view of the detachable combination tool in accordance with the preferred embodiment of the present invention.
Figure 3:
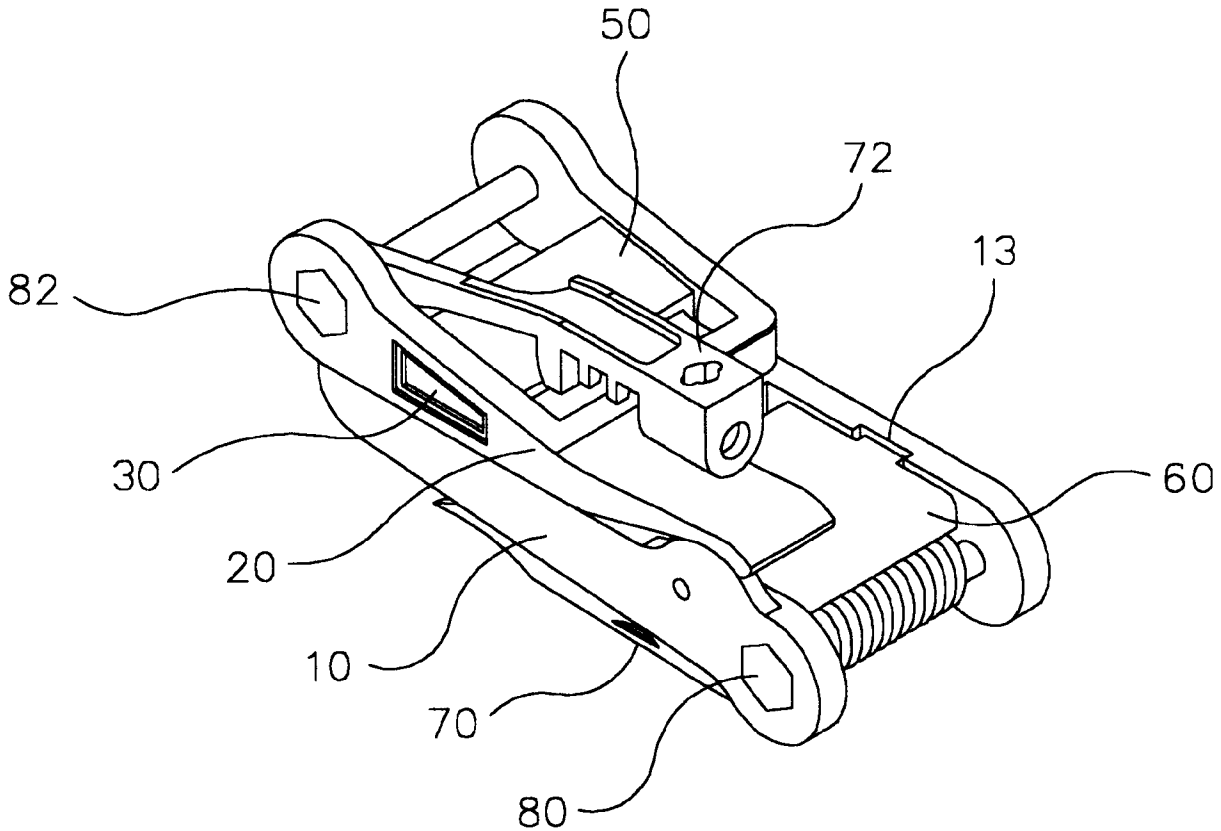
FIG. 3 is a perspective assembly view of the detachable combination tool in accordance with the preferred embodiment of the present invention.

Referring to the drawings and initially to FIGS. 1–5, a detachable combination tool in accordance with the preferred embodiment of the present invention comprises a first body 10, a second body 20, two locking blocks 30, and an elastic member 40.

The first body 10 has an inside formed with a receiving chamber 11. The receiving chamber 11 of the first body 10 has a first end having two sides each formed with a snap recess 12 and a second end having two sides each formed with a pivot recess 13. The first body 10 has a distal end formed with a pivot hole 15.

The second body 20 is detachably mounted on the first body 10 and has a bottom provided with a protruding block 21 received in the receiving chamber 11 of the first body 10. The protruding block 21 of the second body 20 has two sides each formed with a through hole 22 aligning with the respective snap recess 12 of the first body 10. The second body 20 has two sides each formed with a press slot 23 located above the respective through hole 22 of the protruding block 21. The second body 20 has a distal end formed with a pivot hole 24.

Each of the two locking blocks 30 is movably mounted in the respective press slot 23 of the second body 20 and has a bottom provided with a protruding locking portion 31 extended through the respective through hole 22 of the protruding block 21 of the second body 20 and detachably locked in the respective snap recess 12 of the first body 10, so that the second body 20 is detachably fixed to the first body 10 by the two locking blocks 30.

The elastic member 40 is mounted between the two locking blocks 30 for pressing the two locking blocks 30 toward the second body 20, so that the locking portion 31 of each of the two locking blocks 30 is pressed to be locked in the respective snap recess 12 of the first body 10. Preferably, each of the two locking blocks 30 is formed with a receiving portion 32 to receive the elastic member 40.

The detachable combination tool further comprises a cover 50 mounted on the second body 20 to encompass the two locking blocks 30 and the elastic member 40, so that the two locking blocks 30 and the elastic member 40 are sealed in the second body 20.

The detachable combination tool further comprises a control plate 60 mounted on the first body 10 and having two sides each provided with a pivot ear 62 pivotally mounted in the pivot recess 13 of the first body 10.

The detachable combination tool further comprises a first pivot rod 80 pivotally mounted in the pivot hole 15 of the first body 10, and a first tool 70 secured on the first pivot rod 80 to pivot therewith.

The detachable combination tool further comprises a second pivot rod 82 pivotally mounted in the pivot hole 24 of the second body 20, and a second tool 72 secured on the second pivot rod 82 to pivot therewith.

Figure 4:
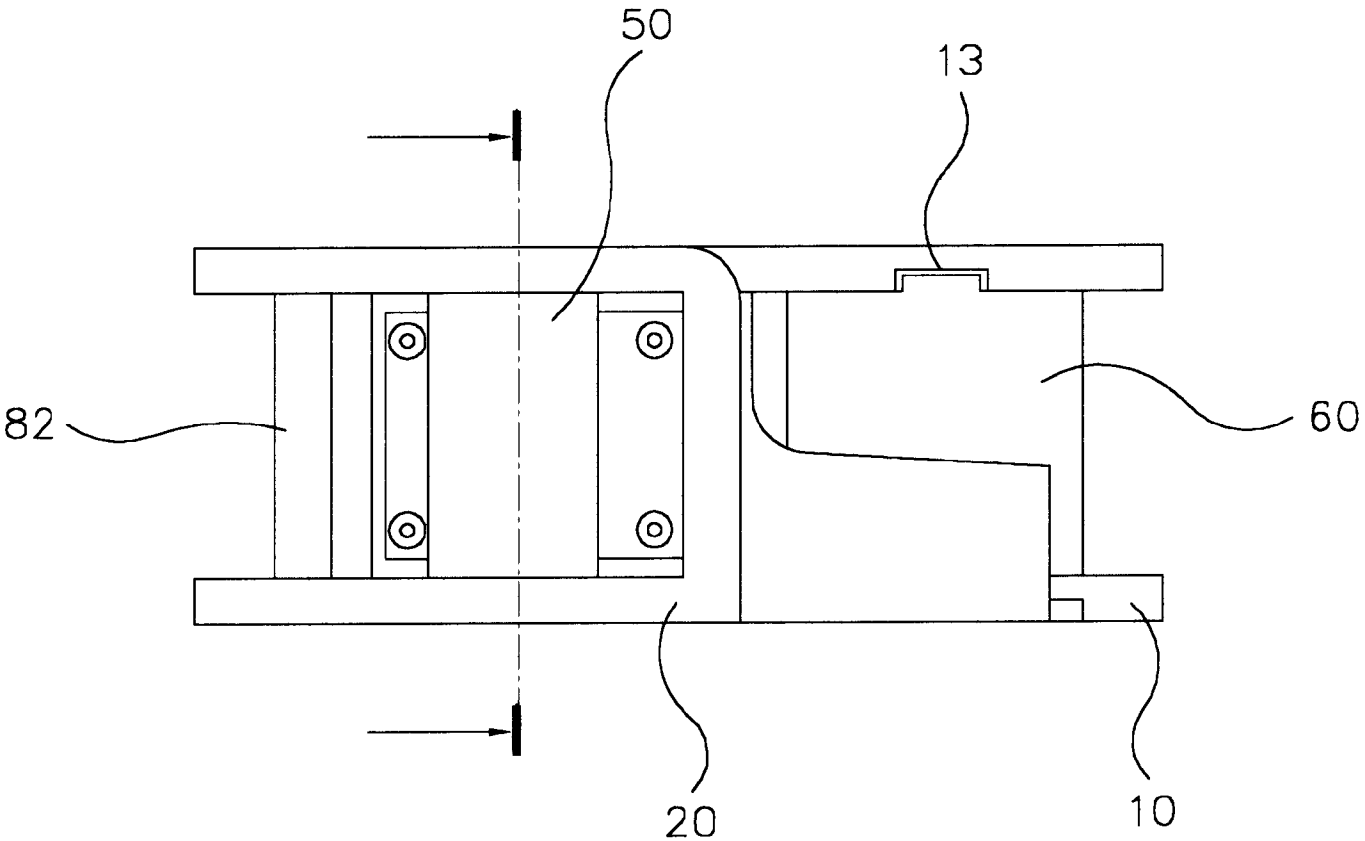
FIG. 4 is a top plan view of the detachable combination tool as shown in FIG. 3.
Figure 4A:
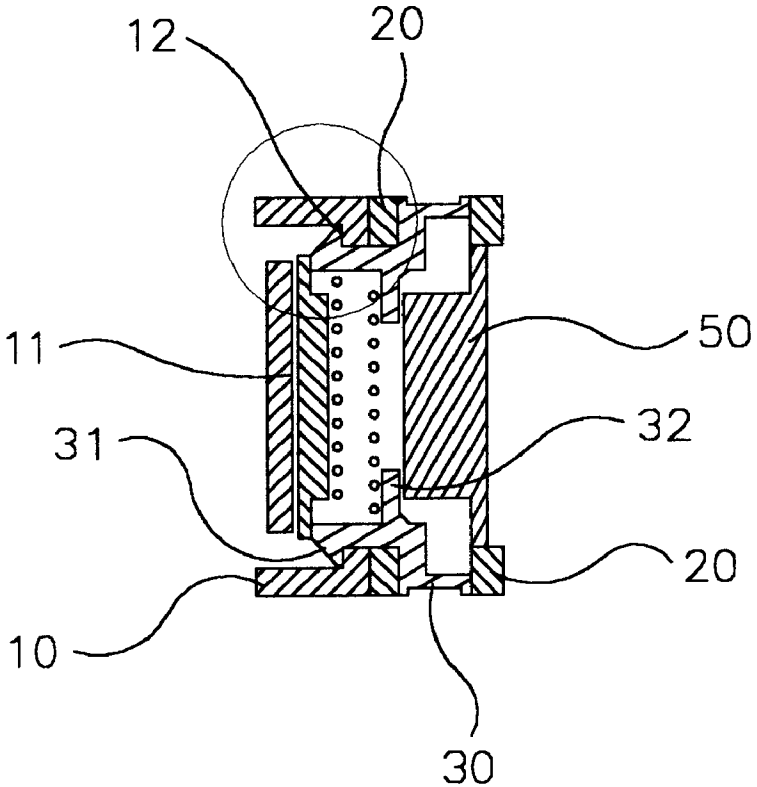
FIG. 4A is a plan cross-sectional view of the detachable combination tool as shown in FIG. 4.
Figure 4B:
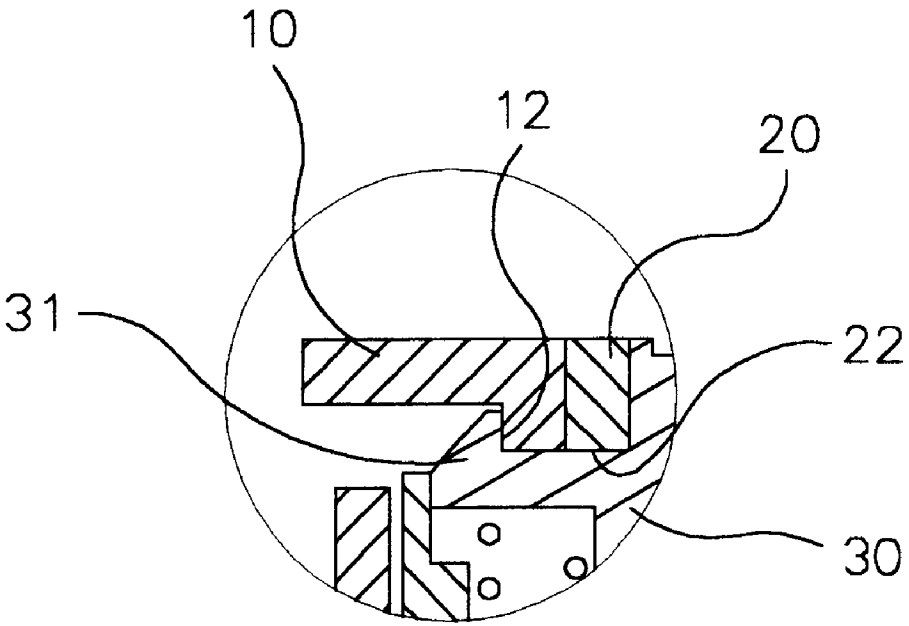
FIG. 4B is a partially enlarged view of the detachable combination tool as shown in FIG. 4A.
Figure 5:
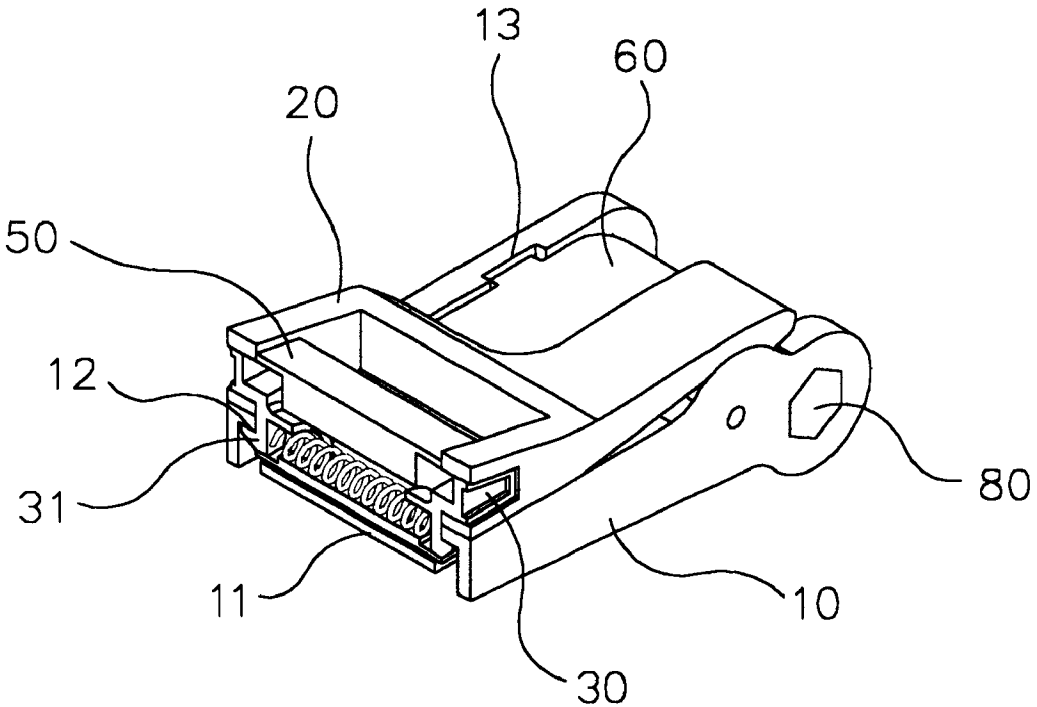
FIG. 5 is a perspective assembly view of the detachable combination tool in accordance with the preferred embodiment of the present invention.

As shown in FIGS. 4, 4A and 4B, the two locking blocks 30 are pressed outward by the elastic member 40 to move toward the second body 20, so that the locking portion 31 of each of the two locking blocks 30 is extended through the respective through hole 22 of the protruding block 21 of the second body 20 and is detachably locked in the respective snap recess 12 of the first body 10, thereby combining the second body 20 with the first body 10 by the two locking blocks 30.

Figure 6:
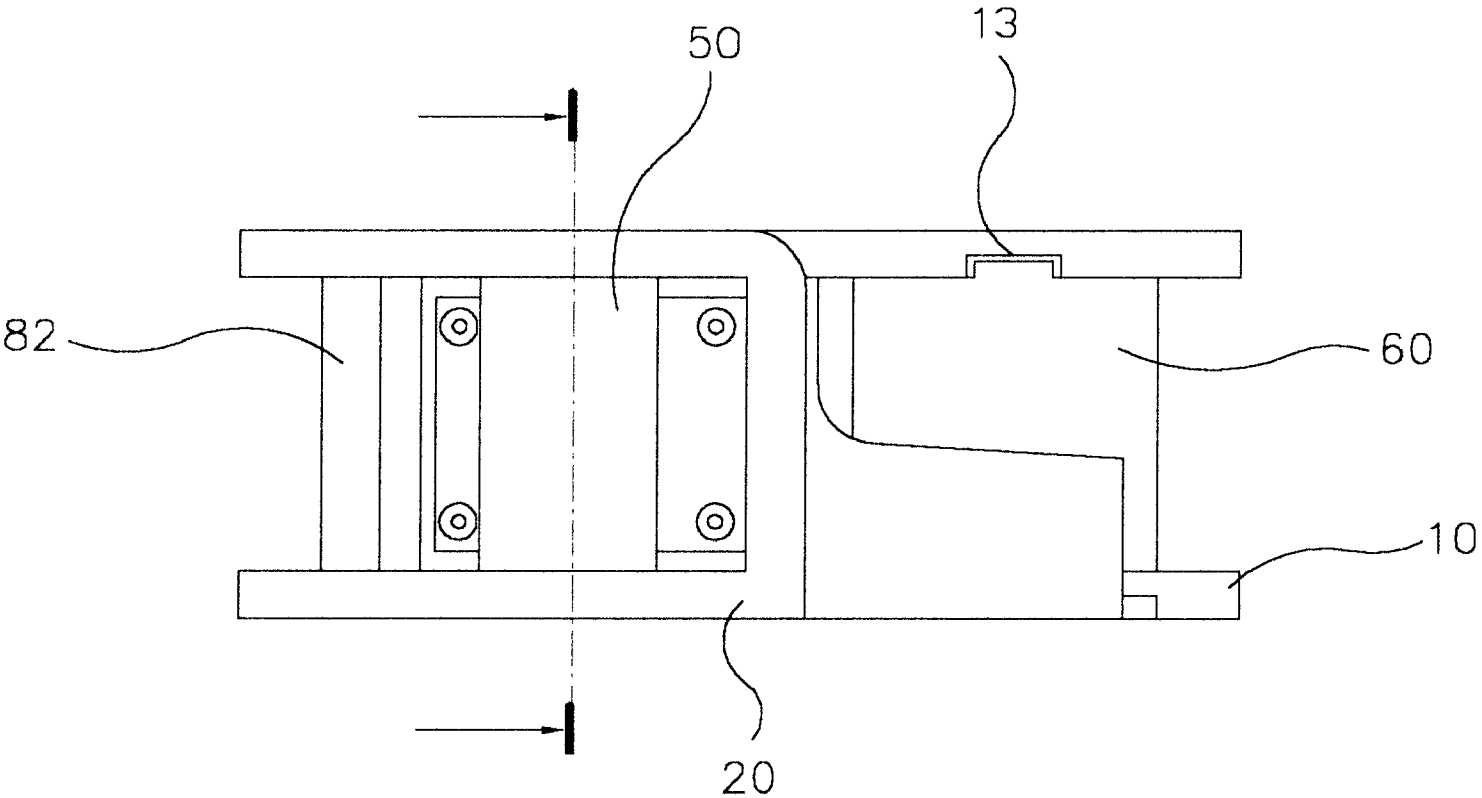
FIG. 6 is a top plan view of the detachable combination tool as shown in FIG. 3.
Figure 6A:
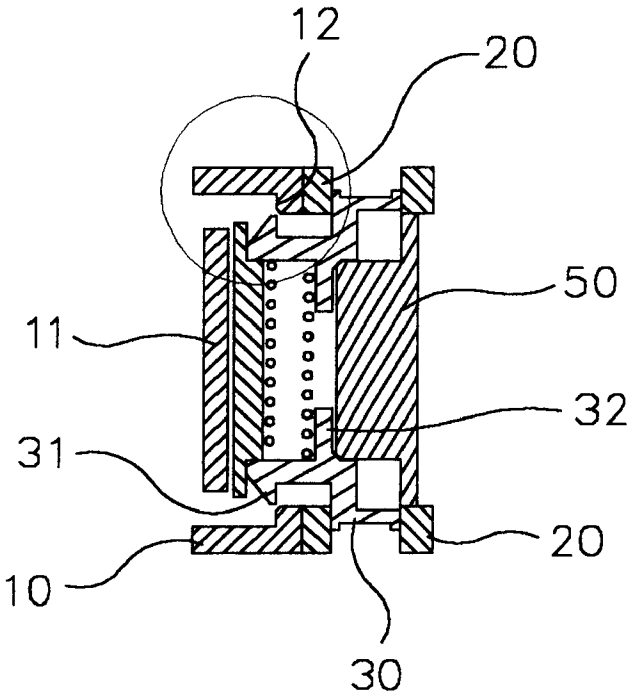
FIG. 6A is a plan cross-sectional view of the detachable combination tool as shown in FIG. 6.
Figure 6B:
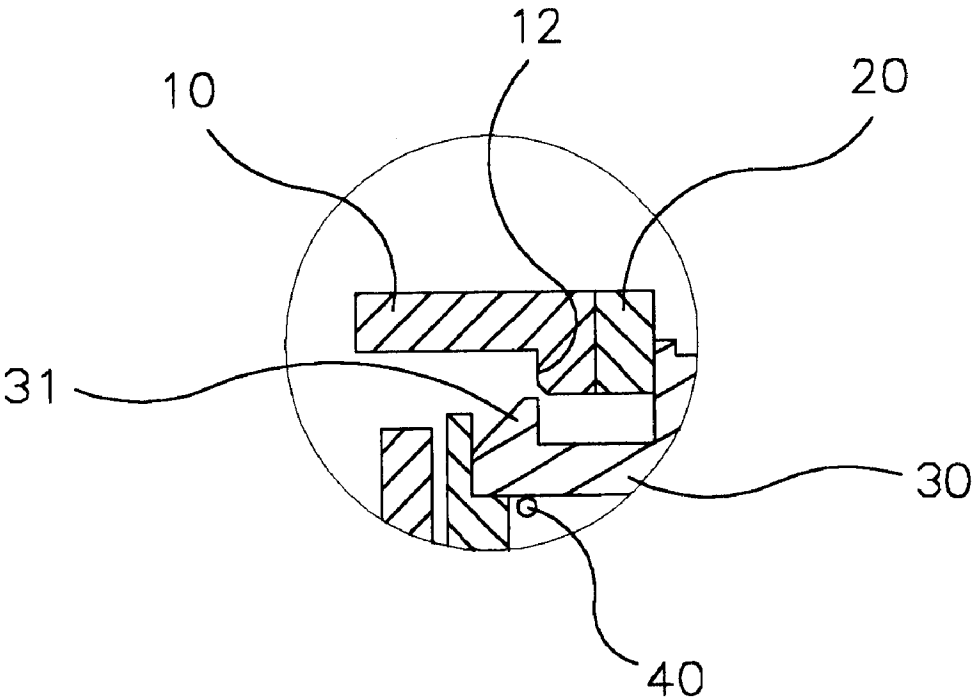
FIG. 6B is a partially enlarged view of the detachable combination tool as shown in FIG. 6A.
Figure 7:
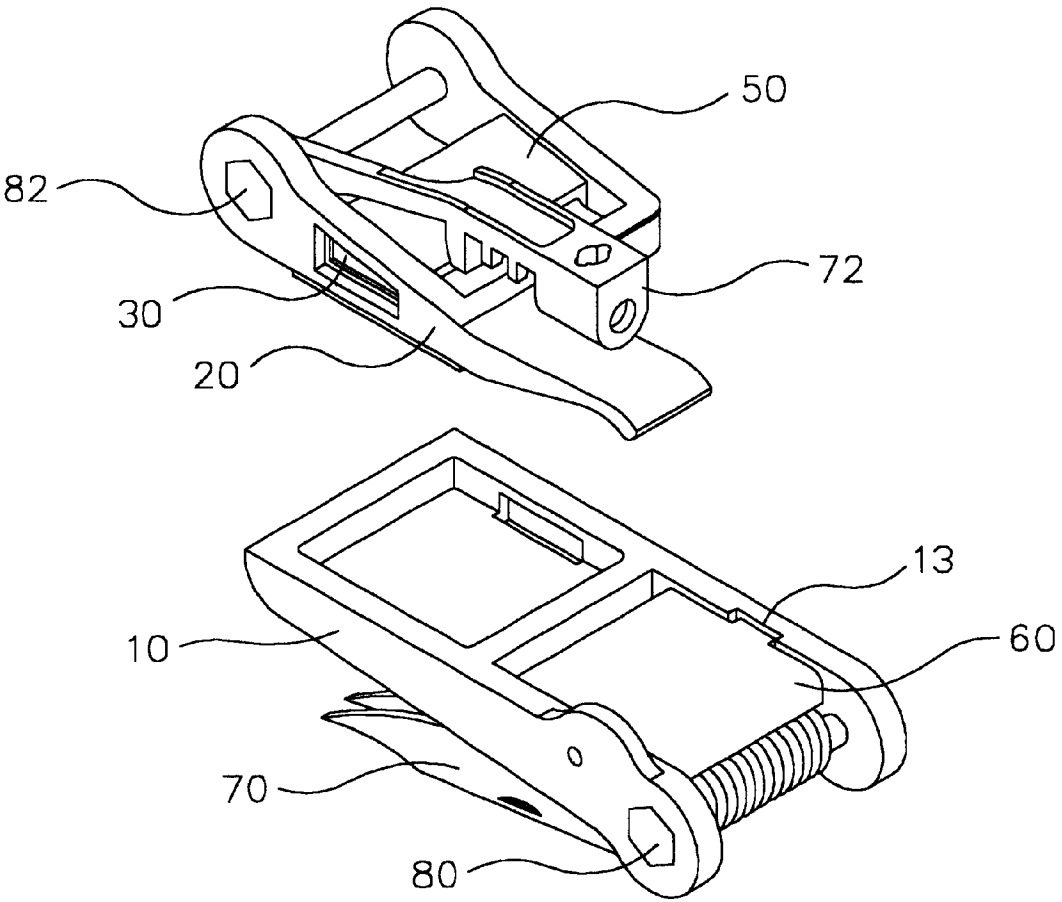
FIG. 7 is a perspective detached view of the detachable combination tool in accordance with the preferred embodiment of the present invention.

As shown in FIGS. 6, 6A and 6B, the two locking blocks 30 are pressed inward by the user's two fingers, to move away from the second body 20, so that the locking portion 31 of each of the two locking blocks 30 is detached from the respective snap recess 12 of the first body 10, thereby releasing the second body 20 from the first body 10, so that the second body 20 can be detached from the first body 10 as shown in FIG. 7. Thus, the second body 20 and the first body 10 can be used individually and independently.

Accordingly, when the second body 20 is mounted on the first body 10, the protruding block 21 of the second body 20 is received in the receiving chamber 11 of the first body 10, and the locking portion 31 of each of the two locking blocks 30 is extended through the respective through hole 22 of the protruding block 21 of the second body 20 and is locked in the respective snap recess 12 of the first body 10, so that the second body 20 is combined with the first body 10 rigidly and stably by the two locking blocks 30. In addition, the protruding block 21 of the second body 20 is secured in the receiving chamber 11 of the first body 10, so that the force or torque applied on the second body 20 and the first body 10 during operation is evenly distributed on and supported by the protruding block 21 of the second body 20 and the wall of the receiving chamber 11 of the first body 10. Thus, the combination tool can withstand a larger torque or force during operation.

Figure 8:
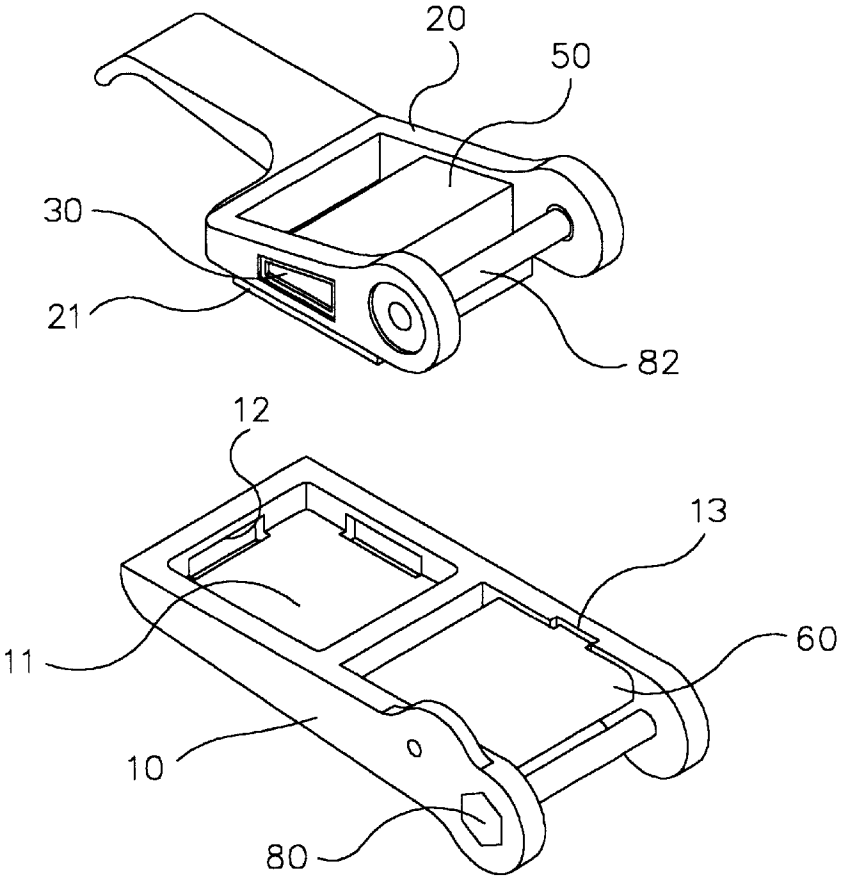
FIG. 8 is a perspective detached view of the detachable combination tool in accordance with another embodiment of the present invention.

Referring to FIG. 8, the detachable combination tool in accordance with another embodiment of the present invention is shown, wherein the receiving chamber 11 of the first body 10 has a square shape and has a first end having four sides each formed with a snap recess 12, and the protruding block 21 of the second body 20 has a square shape to mate with that of the receiving chamber 11 of the first body 10.

Figure 9:
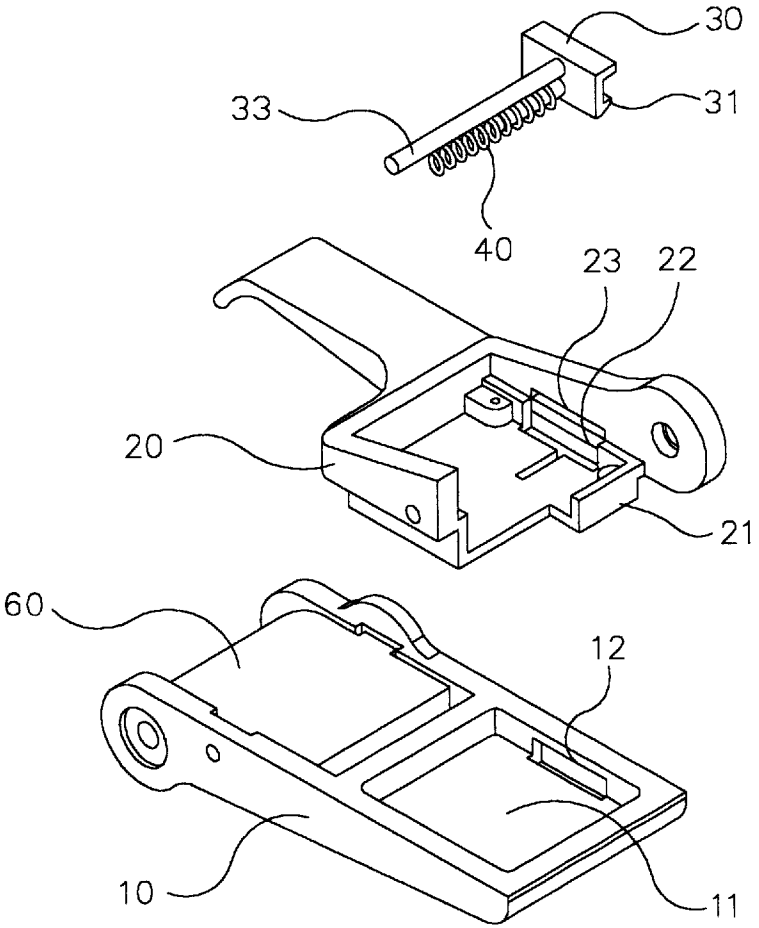
FIG. 9 is an exploded perspective view of the detachable combination tool in accordance with a further embodiment of the present invention.
Figure 10:
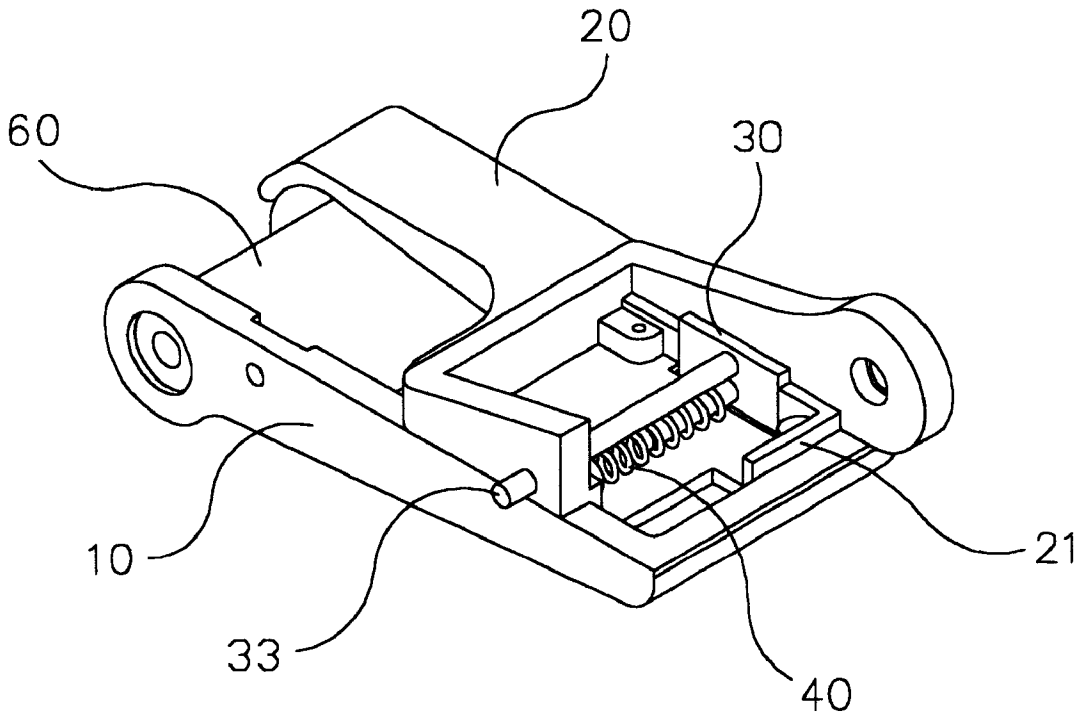
FIG. 10 is a perspective assembly view of the detachable combination tool as shown in FIG. 9.

Referring to FIGS. 9 and 10, the detachable combination tool in accordance with a further embodiment of the present invention is shown, wherein the detachable combination tool comprises a single locking block 30. In addition, the second body 20 has a side formed with a passage hole 24, the locking block 30 has an inner side provided with a pull rod 33 extended through and protruded outward from the passage hole 24 of the second body 20, and the elastic member 40 is mounted between the locking block 30 and the second body 20.

In operation, the pull rod 33 can be pulled outward to pull the locking block 30 to move outward, so that the locking portion 31 of the locking block 30 is detached from the snap recess 12 of the first body 10, thereby releasing the second body, 20 from the first body 10, so that the second body 20 can be detached from the first body. Thus, the second body 20 and the first body 10 can be used individually and independently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A detachable combination tool, comprising a first body, a second body, and two locking blocks, wherein:

the first body has an inside formed with a receiving chamber;

the receiving chamber of the first body has two sides each formed with a snap recess;

the second body is detachably mounted on the first body and has a bottom provided with a protruding block received in the receiving chamber of the first body;

the protruding block of the second body has two sides each formed with a through hole aligning with the respective snap recess of the first body; and each of the two locking blocks is movably mounted on the second body and has a bottom provided with a protruding locking portion extended through the respective through hole of the protruding block of the second body and detachably locked in the respective snap recess of the first body, so that the second body is detachably fixed to the first body by the two locking blocks.

2. The detachable combination tool in accordance with claim 1, wherein the first body has an end having two sides each formed with a pivot recess, and the detachable combination tool further comprises a control plate mounted on the first body and having two sides each provided with a pivot ear pivotally mounted in the pivot recess of the first body.

3. The detachable combination tool in accordance with claim 1, wherein the first body has a distal end formed with a pivot hole, and the detachable combination tool further comprises a first pivot rod pivotally mounted in the pivot hole of the first body, and a first tool secured on the first pivot rod to pivot therewith.

4. The detachable combination tool in accordance with claim 1, wherein the second body has a distal end formed with a pivot hole, and the detachable combination tool further comprises a second pivot rod pivotally mounted in the pivot hole of the second body, and a second tool secured on the second pivot rod to pivot therewith.

5. The detachable combination tool in accordance with claim 1, wherein the second body has two sides each formed with a press slot located above the respective through hole of the protruding block, and each of the two locking blocks is movably mounted in the respective press slot of the second body.

6. The detachable combination tool in accordance with claim 1, further comprising an elastic member mounted between the two locking blocks for pressing the two locking blocks toward the second body, so that the locking portion of each of the two locking blocks is pressed to be locked in the respective snap recess of the first body.

7. The detachable combination tool in accordance with claim 6, wherein each of the two locking blocks is formed with a receiving portion to receive the elastic member.

8. The detachable combination tool in accordance with claim 1, further comprising a cover mounted on the second body to encompass the two locking blocks and the elastic member, so that the two locking blocks and the elastic member are sealed in the second body.

9. The detachable combination tool in accordance with claim 1, wherein the receiving chamber of the first body has a square shape, and the protruding block of the second body has a square shape to mate with that of the receiving chamber of the first body.

10. The detachable combination tool in accordance with claim 1, wherein the receiving chamber of the first body has a first end having four sides each formed with a snap recess to receive the locking portion of the respective locking block.

11. The detachable combination tool in accordance with claim 1, wherein the detachable combination tool comprises a single locking block, the second body has a first side formed with a passage hole, the locking block has an inner side provided with a pull rod extended through and protruded outward from the passage hole of the second body.

12. The detachable combination tool in accordance with claim 11, further comprising an elastic member mounted between the locking block and the first side of the second body for pressing the locking block toward a second side of the second body, so that the locking portion of the locking block is pressed to be locked in the snap recess of the first body.

* * * * *